United States Patent [19]

Marcus et al.

[11] 4,046,190

[45] Sept. 6, 1977

[54] FLAT-PLATE HEAT PIPE

[75] Inventors: Bruce D. Marcus, Los Angeles; George L. Fleischman, Inglewood, both of Calif.

[73] Assignee: The United States of America as represented by the Administrator of the National Aeronautics and Space Administration, Washington, D.C.

[21] Appl. No.: 579,989

[22] Filed: May 22, 1975

[51] Int. Cl.[2] ..... F28D 15/00
[52] U.S. Cl. ..... 165/105
[58] Field of Search ..... 165/105

[56] References Cited

U.S. PATENT DOCUMENTS

| | | | |
|---|---|---|---|
| 3,603,767 | 9/1971 | Scicehitano | 165/105 X |
| 3,613,778 | 10/1971 | Feldman, Jr. | 165/105 |
| 3,734,173 | 5/1973 | Moritz | 165/105 |

*Primary Examiner*—Albert W. Davis, Jr.
*Attorney, Agent, or Firm*—John O. Tresansky; Robert Kinberg; John R. Manning

[57] ABSTRACT

Flat-plate (vapor chamber) heat pipes are made by enclosing metal wicking between two capillary grooved flat panels. These heat pipes provide a unique configuration and have good capacity and conductance capabilities in zero gravity. When these flat-plate vapor chamber heat pipes are heated or cooled, the surfaces are essentially isothermal, varying only 3° to 5° C over the panel surface.

6 Claims, 1 Drawing Figure

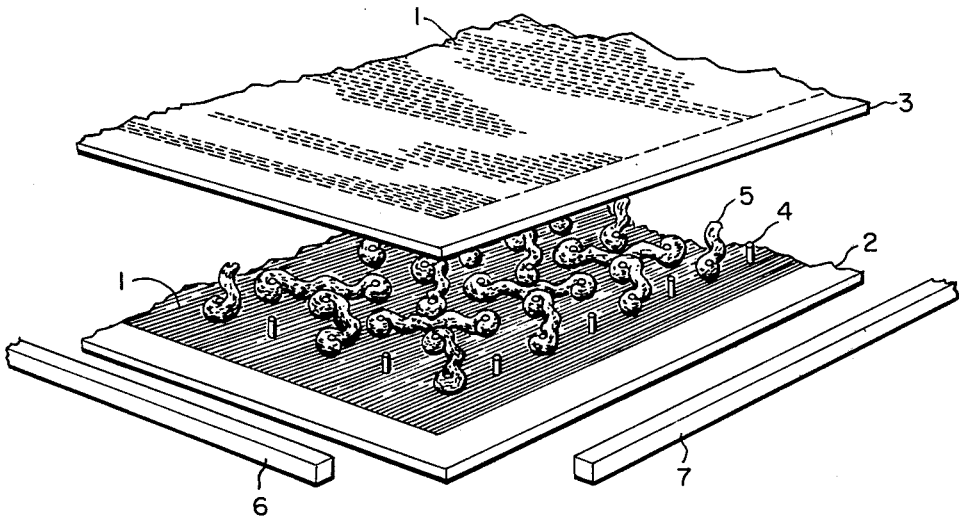
1
3
5
4
2
1
6
7

FLAT-PLATE HEAT PIPE

The invention described herein was made in the performance of work under a NASA contract and is subject to the provisions of Section 305 of the National Aeronautics and Space Act of 1958, Public Law 85-568 (72 Stat. 435; 42 U.S.C. 2457).

BACKGROUND OF THE INVENTION

Heat pipes or heat pipe-type devices operate on closed evaporating-condensing cycles for transporting heat from a locale of heat addition to a locale of heat rejection, using a capillary structure or wick for return of the condensate. Such devices generally consist of a closed container which may be of any shape or geometry. Early forms of these devices had the shape of a pipe or tube closed on both ends and the term "heat pipe" was derived from such devices. The term "heat pipe," as used herein however, refers to a device of any type of geometry designed to function as described above.

In such a heat pipe device, air or other noncondensable gases are usually removed from the internal cavity of the container. All interior surfaces are lined with a capillary structure, such as a wick. The wick is soaked with a fluid which will be in the liquid phase at the normal working temperature of the device. The free space of the cavity then contains only the vapor of the fluid at a pressure corresponding to the saturation pressure of the working fluid at the temperature of the device. If, at any location, heat is added to the container, the resulting temperature rise will increase the vapor pressure of the working fluid, and evaporation of liquid will take place. The vapor that is formed, being at a higher pressure, will flow towards the colder regions of the container cavity and will condense on the cooler surfaces inside the container wall. Capillary effects will return the liquid condensate to areas of heat addition. Because the heat of evaporation is absorbed by the phase change from liquid to vapor and released when condensation of the vapor takes place, large amounts of heat can be transported with very small temperature gradients from areas of heat addition to areas of heat removal.

SUMMARY OF THE INVENTION

Flat-plate vapor chamber heat pipes are fabricated by sealing two flat plates together in parallel planes so that the edges are aligned normal to the surface of the plates. Surfaces of the plates facing each other have capillary grooves at right angles to each other; i.e., the capillary grooves in one plate are at right angles to the grooves in the opposing plate so the working fluid can flow in all directions. Metal wicking is arranged between the plates so as to intersect every groove on the surface of both plates to provide fluid flow from plate to plate and a vapor path to all portions of the plate. The working fluid is sealed between the flat grooved panels and condenses at spots where the heat is removed and evaporates at places where heat is applied.

Heat pipes of this invention can be used as electronic cold plates for mounting high power density electronic equipment, substrates for integrated circuit chips, solar cells, or laser mirrors.

Typical flat-plate heat pipes according to this invention, utilizing methanol as the working fluid, can demonstrate a heat input flux of 2.8 watts/square centimeter with a 3° to 5° C temperature difference throughout the panel surface at zero gravity. Typical capacity of the flat-plate heat pipe may be about 25 watt-in/in at 0.5 inch evaporator elevation and 50 watt-in/in in zero gravity using methanol at 55° F. Typical conductances were approximately 1 watt/in$^2$–° F at the evaporator and 0.3 watt/in$^2$-° F at the condenser. Higher values for all these parameters are possible with water as the working fluid.

BRIEF DESCRIPTION OF THE DRAWING

The FIGURE in the drawing is a perspective view of a disassembled flat-plate vapor chamber heat pipe.

DESCRIPTION OF THE PREFERRED EMBODIMENTS

Referring to the FIGURE in the drawing, capillary grooves 1 are machined or etched into the facing surfaces of plates 2 and 3. Spacing studs 4 are aligned at regular intervals to provide structural support for panels 2 and 3 as well as an anchor for metal wicking 5. Metal wicking 5 is arranged so that they collective cross or intersect every groove on the faces of plates 2 and 3. Side bars 6 and 7 are joined at the edges of panels 2 and 3 to provide further structural support and spacing of the panels, as well as a seal for the working fluid. Side bars 6 and 7 and spacing studs 4 are joined to panels 2 and 3 by any suitable means, for example, soldering, brazing, welding, or diffusion bonding.

Plates 2 and 3 can be made from any of the structural metals. Metals such as copper, brass, nickel, stainless steel, Monel, and titanium are a few which are suitable for these heat pipes.

When choosing a metal for the heat pipe, consideration must be given to selecting a compatible working fluid. The working fluid must be compatible with the metal under all conditions to which the heat pipe will be exposed or corrosion will occur. It has been found that copper, brass, nickel, and stainless steel are compatible with methanol while copper, Monel, and titanium are compatible with water.

Water, methanol, and ammonia are three well-known low temperature working fluids. Ammonia is not suitable for flat plate heat pipes because it has a high vapor pressure at ambient conditions and would be difficult to contain without deformation of the flat plates. While high pressures in tubular heat pipes is but a minor problem, pressurization in flat-plate heat pipes presents more serious considerations. Hence, in the near ambient temperature ranges, low pressure fluids such as water and methanol are the most suitable working fluids. Where higher temperature ranges are contemplated for the heat pipe use, other working fluids, exhibiting low vapor pressures at the desired operating temperatures, would be required.

Capillary grooves 1, in plates 2 and 3, may be formed by any suitable process means. Generally, chemical milling or photofabrication by processes well-known in the art is employed to etch the capillary grooves into the surface of the plates. Metals which form wide shallow grooves when etched, as exexemplified by stainless steel, are less desirable than metals which form the narrow grooves necessary for the capillary effect as examplified by copper.

Capillary grooves 1 on panel 2 are oriented 90° to capillary grooves 1 on panel 3. This right angle orientation of grooves 1 in combination with metal wicking 5 provides a continuous liquid path from any one groove to any other within the enclosure. This will allow continuous circulation of working fluid between all points of the heat pipe. Nearly isothermal heat transfer is achieved by virture of a practically uniform internal vapor pressure and temperature in combination with extremely high coefficients of evaporation and condensation heat transfer from and to grooved surfaces.

We claim:

1. A heat pipe device comprising:

i. two flat-plates in parallel planes having edges sealed and aligned normal to the parallel plates with capillary grooves in the facing surfaces at right angles to the grooves of the opposing plate; and ii. metal wicking intersecting every groove.

2. A heat pipe device according to claim 1 wherein: said metal wicking is metal wire felt.

3. A heat pipe device according to claim 1 wherein: said metal wicking is porous sintered powdered metal.

4. A heat pipe device comprising:

i. two equidistant flat plates having sealed aligned edges normal to the surfaces and capillary grooves in the opposing surfaces at right angles to the grooves of the opposing plate;

ii. metal wicking intersecting every groove; and iii. a working fluid sealed between said plates.

5. A heat pipe device according to claim 4 wherein: said metal wicking is metal wire felt.

6. A heat pipe device according to claim 4 wherein: said metal wicking is porous sintered powdered metal.

* * * * *